United States Patent [19]

Iantorno

[11] 4,359,253

[45] Nov. 16, 1982

[54] FEMALE ELECTRICAL CONNECTOR FOR REDUCED PIN GRID APPLICATIONS

[75] Inventor: James Iantorno, Mamaroneck, N.Y.

[73] Assignee: Sealectro Corporation, Mamaroneck, N.Y.

[21] Appl. No.: 218,625

[22] Filed: Dec. 22, 1980

[51] Int. Cl.[3] ..... H01R 31/08

[52] U.S. Cl. ..... 339/19; 339/217 S

[58] Field of Search ..... 339/19, 222, 217 S

[56] References Cited

U.S. PATENT DOCUMENTS 4,190,308 2/1980 Iantorno ..... 339/19

*Primary Examiner*—Neil Abrams

*Attorney, Agent, or Firm*—Hedman, Casella, Gibson & Costigan

[57] ABSTRACT

An electrical connector is disclosed for electrically connecting a pair of spaced apart conductive pin members. More particularly, an electrical connector is disclosed comprising an elongated housing having opposed cover members and further including an elongated actuator member extending therebetween. A continuous, electrically conductive contact member is provided which is resilient and has a dumbbell-shaped configuration. The contact member is disposed about the actuator member in a loose fit relationship. During mounting of the connector, the actuator member effects an elongation of the contact member to reduce mounting forces. The unique configuration of the contact member enables a redundant electrical connection to be established between the pins and the contact member. In a preferred embodiment of the subject invention, the connector housing is rectangular having opposed pairs of side walls. Pin receiving apertures are provided in the side walls, with the spacing between the apertures in one pair of side walls being different than the spacing between the apertures in the other pair of side walls enabling the connector to be utilized with two different size pin grids.

20 Claims, 14 Drawing Figures

FEMALE ELECTRICAL CONNECTOR FOR REDUCED PIN GRID APPLICATIONS

BACKGROUND OF THE INVENTION

The subject invention relates to a new and improved female electrical connector or shorting jack for use in reduced pin grid applications. More particularly, a connector is provided including a contact member having a dumbbell-shaped configuration which enables a redundant electrical interconnection to be established between the contact pin members. In a preferred embodiment of the subject invention, the connector is configured to be utilized with pin grids of different sizes.

In many electrical devices, circuitry is provided on a planar substrate, such as a circuit board, which includes a plurality of upstanding pins disposed in parallel arrays forming a grid. In certain applications, it is necessary to provide a means for readily interconnecting or shorting adjacent pin members of the grid. For example, in telephone switching systems, incoming and outgoing lines must be electrically bridged in order to create the desired electrical pathway.

A variety of female electrical connectors or shorting jacks have been developed in the prior art. One such shorting jack can be found in U.S. Pat. No. 4,190,308, assigned to the same assignee as the subject invention, which issued on Feb. 26, 1980 Iantorno, the subject matter of which is incorporated herein by reference. The shorting jack which is disclosed in the above identified application, provides for a unique electrical connector which is relatively simple in construction, and has a "reduced insertion force" capability. Briefly, this capability is achieved by placing a continuous electrical contact member about a central hub extending between a pair of opposed cover members. The dimensions of the contact member are such that the opposed edges thereof are spaced apart a distance greater than the distance between the spaced apart pin members of the grid. By this arrangement, when the connector is mounted on the pins, the pin members resist the downward pushing action such that the central hub exerts a downward force on the radially inner lead portion of the contact member thereby effecting an elongation of the contact. This elongation of the contact causes a reduction in the force required to push the connector over the pins. When the connector is fully mounted onto the pins, the hub member ceases to exert a force on the contact member, which permits the contact to revert towards its original position, thereby achieving a secure interference fit and electrical interconnection between the pins and the contact.

The cooperation between the floating contact and the central hub to achieve a reduced insertion force capability provides an improvement over the prior art. With the ever increasing drive towards miniaturization, circuit boards have been recently designed wherein the spacing between the center line of adjacent pins has been reduced to 0.100 of an inch, which are commonly referred to as grids with 0.100 inch centers. Female electrical connectors may be designed for these reduced grids by scaling down the dimensions of the connectors disclosed in U.S. Pat. No. 4,190,308. These scaled down versions, while functional, are difficult to produce. More specifically, in order to maintain the necessary resilience and spring-like qualities of a reduced diameter inner contact, it is necessary to also reduce its thickness. It has been found that production of a thin contact is relatively difficult particularly in the initial fabrication and deburring steps, and in handling. In addition, using a reduced diameter circular contact results in the make points (contact areas) being spaced further from the pin receiving apertures.

Accordingly, it is an object of the subject invention to provide a new and improved electrical connector which is provided with "reduced insertion force" capabilities, while circumventing the difficulties of fabricating a reduced diameter and thickness contact made according to the prior art.

It is another object of the subject invention to provide a new and improved female electrical connector for use with reduced pin grid applications which includes a dumbbell-shaped contact member which may be produced by deforming a prior art circular contact such that manufacturing costs are substantially reduced.

It is a further object of the subject invention to provide a new and improved female electrical connector for reduced pin grid applications which is capable of achieving a redundant electrical contact between each pin member of a grid and the electrical contact therein.

It is still another object of the subject invention to provide a new and improved female electrical connector which includes a rectangular housing having two pairs of pin receiving apertures, each pair being spaced apart a different distance enabling a single connector to be used in pin grid applications of various sizes.

SUMMARY OF THE INVENTION

In accordance with these objects, the subject invention provides for an electrical connector for electrically connecting a pair of spaced apart, substantially parallel conductive pin members. More particularly, the electrical connector comprises an elongated hollow housing having opposed, spaced apart, top and bottom cover members. The housing further includes an elongated actuator means formed integrally therewith and extending between the cover members. In a preferred embodiment of the subject invention the actuator means comprises a bar, with the longitudinal axis thereof being disposed parallel to the longitudinal axis of the housing. The housing is further provided with two pairs of opposed side wall members extending between the top and bottom cover members.

In accordance with the subject invention, a continuous, electrically conductive contact member is provided having a unique dumbbell-shaped configuration. The contact member is resilient and is disposed about the actuator means in a loose fit relationship. Each distal end or rounded portion of the contact member defines a pair of opposed contact edges, disposed parallel to the mounting direction of the connector, and are spaced apart a distance greater than the distance between said spaced apart pin members.

In one embodiment of the subject invention, each side wall, adjacent a distal end of the contact, is provided with a generally rectangular pin receiving aperture, having a length greater than the spacing between the pins of the grid. In operation, when the connector is initially pushed over two adjacent pin members, the latter resists the pushing action such that the actuator bar exerts a force on the radially inner lead portion of the contact member thereby effecting an elongation of the contact member which, in turn, reduces the pushing force required to overcome the resistance of the pin members. By this arrangement, the connector is capable of being readily pushed over the pin members until each pin member is respectively disposed in abutting relationship with one contact edge of each distal end of the contact member creating a redundant electrical connection. When the pushing action is stopped, the actuator bar ceases to exert a force on the contact enabling the latter to revert towards its original configuration to effect an interference fit and secure the redundant electrical connections between the pins and the contact member.

In a second embodiment of the subject invention, a generally rectangular housing is provided which includes pairs of square apertures formed in the side walls thereof. In accordance with this embodiment of the subject invention, the spacing between each pair of apertures is different. More specifically, the side walls adjacent the distal ends of the contact may be provided with pin receiving apertures which are adapted to accommodate pins on grids with 0.100 inch centers. In contrast, pin receiving apertures on the remaining longer side walls may be spaced apart a greater distance, such as for example, to accommodate pins on grids with 0.200 inch centers. In this embodiment of the subject invention, the elongated actuator means preferably consists of a pair of upstanding, cylindrical members, which are disposed along the longitudinal axis of the housing. The electrical connector formed in accordance with the latter embodiment, may be used in a manner identical to the above described embodiment when used in conjunction with narrow pin grid dimensions. The subject connector may additionally be used with wider pin grids by rotating the connector about 90° and utilizing the remaining pin receiving slots. By providing for a cylindrical actuator means, the reduced insertion force capability may be achieved in both directions.

In both of the above described embodiments of the subject invention, a generally rectangular contact receiving aperture is provided in the top cover member, having a width slightly less than the width of the contact member. The side edges of the aperture are chamfered to facilitate the insertion of the contact member about the actuator member. The actuator member is further provided with a cap retainer means formed integrally therewith and disposed adjacent the top cover. The dimensions of the contact receiving aperture cooperate with the cap retainers to hold the contact within the housing.

The connector housing of both embodiments is further provided with an elongated groove extending parallel to the longitudinal axis of the connector. The groove functions to facilitate attitude sensing thereby insuring that the connector is properly oriented during the insertion of the contact member by automatic equipment, as described more fully hereinafter.

A third embodiment of the subject invention is also disclosed which is functionally similar to the second embodiment. The housing of the third embodiment, rather than being formed as a one piece integral unit as in the first two embodiments, is of a two piece construction, consisting of top and bottom cover members. When the electrical connector of the third embodiment of the subject invention is manufactured, the contact member is installed around the actuator means and thereafter the top cover member is connected to the bottom cover member. As can be appreciated, since the contact member is installed prior to the sealing of the housing, there is no need to provide a contact receiving aperture in the top cover member, as in the earlier described embodiments.

Other objects and advantages of the subject invention will become apparent from the following detailed description taken in conjunction with the drawings in which:

DESCRIPTION OF THE PREFERRED EMBODIMENTS

Figure 1:
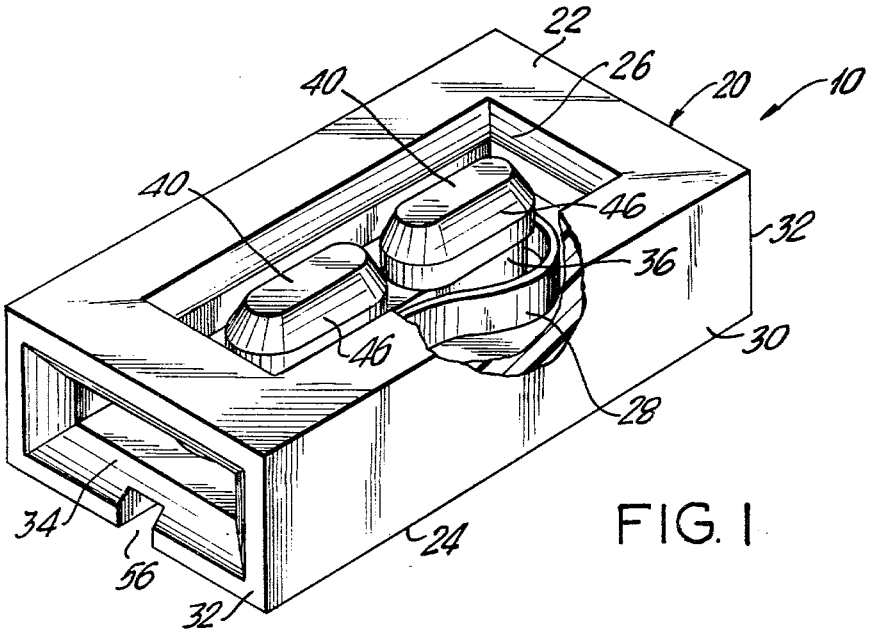
FIG. 1 is a perspective view, partially cut away, of the first embodiment of the new and improved female electrical connector for reduced pin grid applications of the subject invention.
Figure 2:
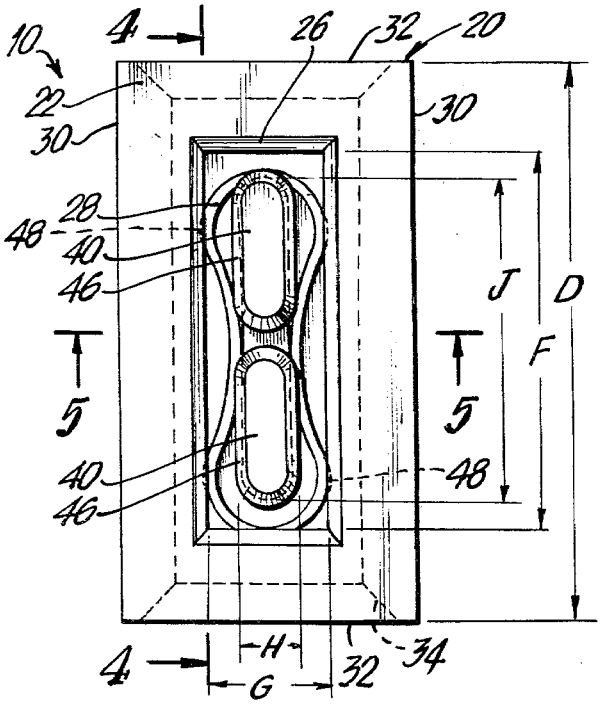
FIG. 2 is a top plan view of the first embodiment of the new and improved electrical connector of the subject invention.
Figure 4:
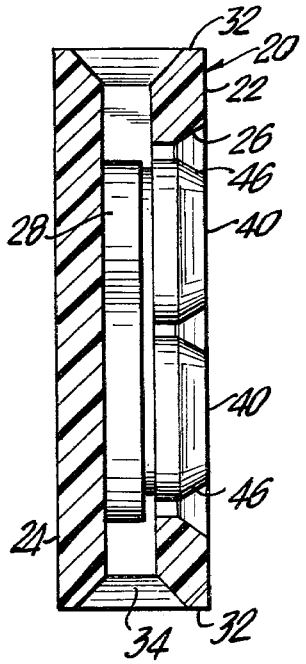
FIG. 4 is a cross-sectional view of the first embodiment of the electrical connector of the subject invention, taken along the line 4—4 of FIG. 2.

Referring now to FIGS. 1–5, there is illustrated a first embodiment of the female electrical connector 10 of the subject invention. More particularly, and as illustrated in FIG. 1, the connector 10 includes a generally rectangular elongated housing 20 formed from a nonconductive material. Preferably, the housing is formed as an integral unit and may be produced from, for example, a flame resistant polyester material by injection molding techniques. Housing 20 includes opposed top and bottom cover members 22 and 24, respectively. Top cover member 22 is provided with a generally rectangular contact receiving aperture 26 having a chamfered peripheral edge, to facilitate the insertion of the contact member 28, as more fully described hereinafter. Two pairs of opposed side walls 30 and 32 extend between the cover members 22 and 24 and are disposed perpendicular thereto. In the first embodiment of the subject invention, each side wall member 32 is provided with a generally rectangular pin receiving aperture 34. Preferably, the peripheral edge of the pin receiving apertures 34 are chamfered to facilitate pin insertion.

Figure 5:
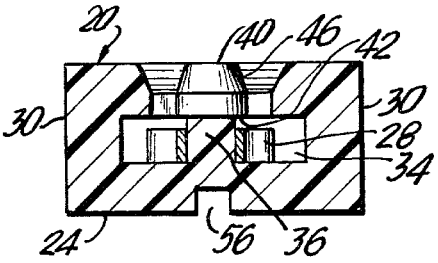
FIG. 5 is a cross-sectional view of the first embodiment of an electrical connector of the subject invention, taken along the line 5—5 of FIG. 2.

In accordance with the subject invention, the connector 10 further includes an actuator bar 36 formed integrally with the housing 20 and extends upwardly from the inner surface of bottom cover member 24. The longitudinal axis of the elongated actuator bar 36 is disposed parallel to the longitudinal axis of the elongated housing 20. Actuator bar 36 further includes a pair of cap retainer members 40, formed integrally therewith and disposed adjacent the top cover member 22 of the housing 20. As illustrated in FIG. 5, the width of each cap retainer member 40 is greater than the width of the actuator bar 36 such that the undersurface thereof defines an overhanging lip 42. Lip 42 cooperates with the dimensions of the rectangular aperture 26 of the top cover member 22 to retain the contact 28 within the housing 20, as more fully described hereinafter. The upper end of each cap retainer member 40 is chamfered at 46 to facilitate the insertion of contact member 28.

As noted above, the female electrical connector as disclosed in U.S. Pat. No. 4,190,308 is a highly reliable device for electrically connecting adjacent pins on a grid. Manufacture of this prior art device for pins grids having 0.200 inch centers, or larger, is relatively simple. While the prior art connector could be successfully scaled downward to accommodate pin grids having 0.100 inch centers, it was found that the difficulties in fabricating a contact having the desired properties were substantial and therefore greatly increased manufacturing costs. For example, when the diameter of the contact was decreased, it was necessary to reduce the thickness of the contact in order to retain the necessary flexibility. By reducing the thickness of the contact, fabrication and handling problems are increased.

Figure 11:
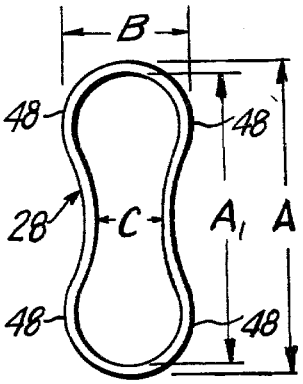
FIG. 11 is a top plan view of the continuous dumbbell-shaped resilient contact member used in conjunction with the electrical connector of the subject invention.

In accordance with the subject invention, a new and improved contact member 28 is provided which obviates the fabrication difficulties encountered in scaling down a connector to accommodate pin grids having 0.100 inch centers. Referring now to FIG. 11, the contact member 28 of the subject invention is illustrated. More specifically, contact member 28, which is preferably formed from beryllium copper, has an elongated, generally dumbbell-shaped configuration. In the first embodiment of the subject invention (as illustrated in FIGS. 1-5), the length A of contact member 28, measured between the radially outer opposed contact surfaces, is equal to 0.243 inches, while its length $A_1$, measured between the radially inner opposed surfaces, is equal to 0.228 inches. The maximum width B, at each distal end thereof is on the order of 0.083 inches. The center waist area is provided with a width C equal to 0.040 inches and the height of the copper contact is 0.024 inches. The unique dumbbell-shaped configuration of the contact member 28 may be achieved by deforming a circular contact either prior to insertion in the housing, or during the insertion procedure. Each rounded or distal end of the contact member 28 defines at least a pair of opposed contact edges 48 which are oriented parallel to the mounting direction of the connector.

Referring now back to FIGS. 1-5, the illustrated connector 10 is intended to be used to short pins spaced apart 0.100 of an inch at their centers. Generally, pins of grids are formed from 0.025 inch square wire such that spacing between the adjacent surfaces of adjacent pin is approximately 0.075 inches, while the spacing between the opposed surfaces of adjacent pins is approximately 0.125 inches. In the first embodiment 10, the length D of the housing 20, is equal to 0.375 inches, while the width E of each side wall member 32, adjacent the distal ends of the contact member is equal to 0.200 inches. The contact receiving aperture 26 provided in the upper cover member 22 has a length F equal to 0.250 inches, and a width G equal to 0.080 inches. In accordance with the subject invention, the width G of aperture 26 is less than the maximum width B of the contact member 28. In addition, the width H of the cap retainer members 40 is equal to 0.045 inches which is greater than the width C of the center waist of the contact member 28. By this arrangement, the configuration of the contact receiving aperture 26 cooperates with the cap retainer members 40 to maintain the contact 28 within the housing. In contrast, the distance J between the opposed ends of actuator bar 36 is approximately 0.205 inches, which is less than the length $A_1$ of the contact member 28, measured between the radially inner opposed surfaces, such that a "loose fit" relationship about the actuator bar is established enabling the contact to move freely, parallel to the longitudinal axis of the housing.

In the formation of the connector 10 of the subject invention, after the housing 20 has been molded, the contact 28 may be inserted by automatic equipment through aperture 26 in the top cover member 22. To facilitate this insertion, the bottom cover member 24 is provided with a longitudinally extending groove 56, having a width equal to 0.030 inches. The longitudinally extending groove 56 facilitates housing attitude sensing in automatic production equipment. More particularly, the feed path of the insertion apparatus may be provided with a central upstanding stop pin. Groove 56 is designed to provide a channel enabling the housing to pass unimpeded along the path. By this arrangement, when the housing is properly oriented with the bottom panel member 24 facing downwardly, the groove 56 will allow the connector to pass unimpeded to the contact inserting apparatus. In contrast, if the connector housing 20 is inverted, the upstanding stop pin will abut the grooveless top cover member 22 thereby halting its progress such that it will never reach the contact inserting apparatus. Accordingly, damage to the contact inserting apparatus which would occur if an attempt was made to insert a contact on the wrong side of the housing is averted. When inserting the contact 28, the chamfered edges of both the receiving aperture 26 and the cap retainer members 40, function to bias the resilient contact member in a manner to faciliate insertion. Once the contact 28 is within the housing 20, below lip 42 of the cap retainer members 40, it will expand to its normal configuration such that it is retained within the housing.

Figure 3:
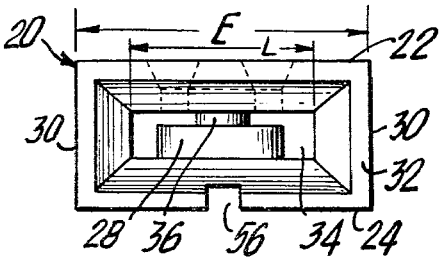
FIG. 3 is an end view of the first embodiment of the electrical connector of the subject invention.

As noted above, the preferred embodiment of the connector is intended to be used with reduced pin grid applications. Accordingly, the pin receiving apertures 34, provided in each side wall 32, are provided with a width L equal to 0.130 inches, as illustrated in FIG. 3. In order to electrically connect a pair of circuit board pins, the connector 10 is mounted on the pins such that they are received within one of the two pin receiving apertures 34. More specifically, the pins are initially guided into the housing by the chamfered side edges of the pin receiving aperture 34. As noted above, the spacing between the adjacent inner surfaces of adjacent pins is on the order of 0.075 inches. In contrast, the opposed edges 48 of each distal end of the contact member 28 are spaced apart a distance B equal to 0.083 inches. Accordingly, as the connector is inserted over the pins, the upward force of the pins tends to move the loose fit contact upwardly into abutting relationship with the leading edge of the actuator bar 36. Continued downward mounting pressure causes the actuator bar 36 to exert a force on the radially inner lead portion of the contact member to effect an elongation thereof which reduces the pushing force necessary to mount the connector on the pins. By this arrangement, the connector is capable of being readily pushed over the pins until each pin is disposed in abutting contact with side edges 48 of both distal ends of the contact. Stated differently, if the pins are long enough to extend essentially the full length of the connector, each pin will be in electrical contact with a side edge 48 of both the lower and upper distal ends of the contact member 28. Once the pushing action is stopped, the actuator bar 36 ceases to exert a force on the contact member 28 enabling it to return towards its original configuration, thereby effecting a secure interference fit and a unique redundant electrical connection between the pins and the contact members.

Upon withdrawal of the connector 10 from the pins, the pins exert a resistance force on the opposed edges of the contact 28. Accordingly, actuator bar 36 exerts an upward force on the top radially inner portion of contact 28 thereby causing it to elongate which, in turn, results in a reduction of the force necessary to remove the connector from the pins. Accordingly, there is provided a new and improved electrical connector 10 adapted for use with reduced pin sizes having a unique contact member 28 which is relatively inexpensive to manufacture and simple to form. The electrical connector 10 is capable of achieving a redundant electrical connection between each pin and the opposed edges 48 of both distal ends of the dumbbell-shaped contact member 28. In the alternative, in some applications it may be desirable to connect pins having a length less than half the length (D) of the connector 10 such that contact is established only along the side edges 48 of the lower distal end of the contact member 28. When used in this manner, the subject connector 10 facilitates jumping or "tapping" in line since the upper distal end of the contact member is free to receive an additional component. More specifically, an additional component or jumping lead may be inserted downwardly through the top of the connector to make electrical contact with the free opposed edges 48 of the upper distal end of the contact member 28. Thus, it is apparent that the dumbbell-shaped configuration of the contact member provides an added utility heretofore lacking in the prior art connectors. Another advantage of the contact configuration is that the elongated shape places the opposed edges 48 of the lower distal end closer to the adjacent pin receiving aperture 10 such that an early contact can be immediately established therebetween.

Referring now to FIGS. 6–10, a second embodiment of the subject connector 100 is illustrated which provides another example of the versatility of the unique dumbbell-shaped configuration of contact member 28. More specifically, and as described more fully hereinbelow, pin receiving apertures are provided on both pairs of side walls of the connector housing to enable a single connector to be used in applications with different pin grid spacings.

Figure 6:
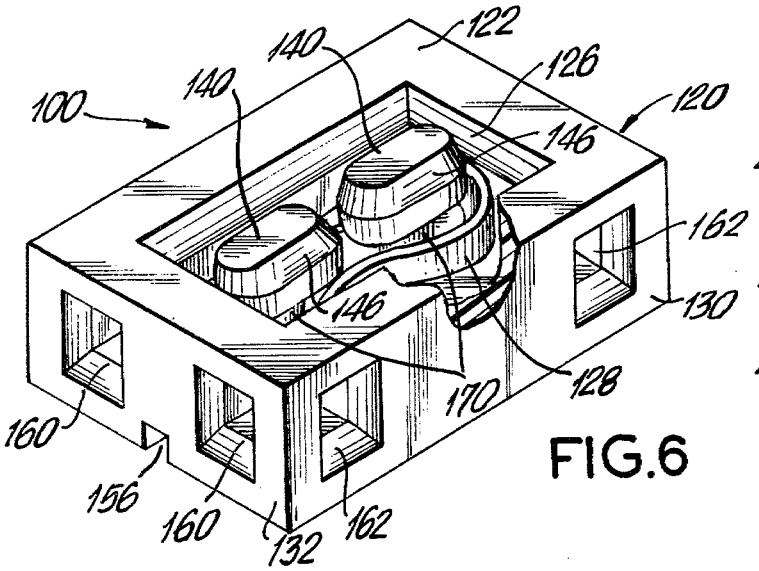
FIG. 6 is a perspective view, partially cut away, of a second embodiment of the electrical connector for reduced pin grid applications of the subject invention.

Referring to FIG. 6, it is apparent that the connector 100 is provided with an integrally formed housing 120, similar to the housing of the first embodiment of the subject invention. More specifically, housing 120 includes top and bottom cover members 122 and 124. Top cover member 122 is provided with a contact receiving aperture 126 having a width less than the width of the contact member 128. Bottom cover member 124 is provided with a longitudinally extending groove 156 for attitude orientation sensing, as described in conjunction with the first embodiment of the subject invention.

Figure 7:
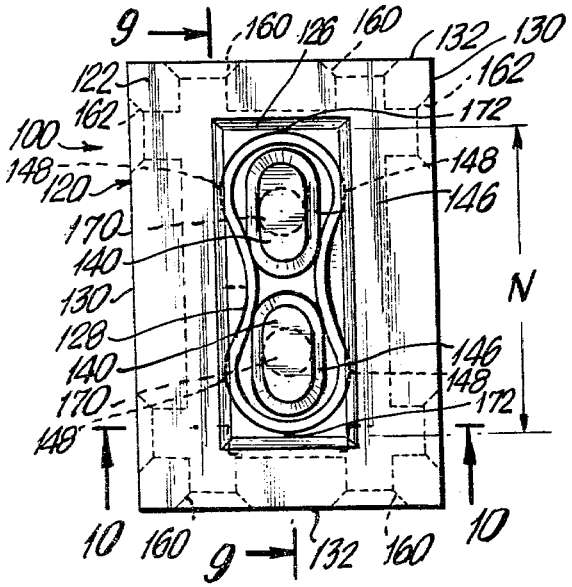
FIG. 7 is a top plan view of the second embodiment of the electrical connector of the subject invention.
Figure 9:
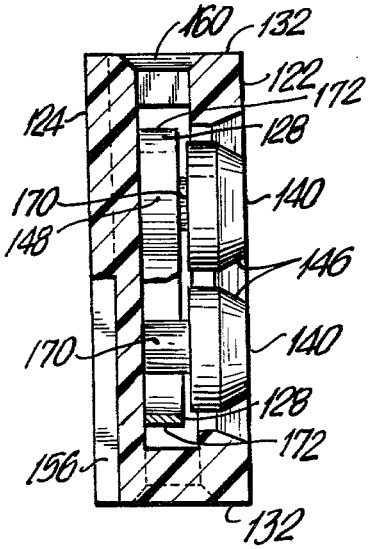
FIG. 9 is a cross-sectional view of the second embodiment of the electrical connector of the subject invention, taken along line 9—9 of FIG. 7.
Figure 8:
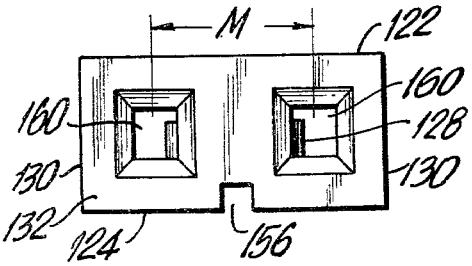
FIG. 8 is an end view of the second embodiment of the electrical connector of the subject invention.

Housing 120 includes two opposed pairs of side walls 130 and 132. Each side wall 132 includes a pair of pin receiving apertures 160 which are chamfered and have a center spacing M therebetween equal to 0.100 inches, as illustrated in FIG. 8. Pin receiving apertures 160 are adapted to receive pins spaced apart on 0.100 inch centers, similar to the first embodiment of the subject connector. The remaining side walls 130 are also provided with pin receiving apertures 162 which are chamfered to facilitate pin insertion. As illustrated in FIG. 7, the center spacing N between pin receiving apertures 162 may be for example, 0.200 inches to accommodate pin grids which are set apart on 0.200 inch centers.

Figure 10:
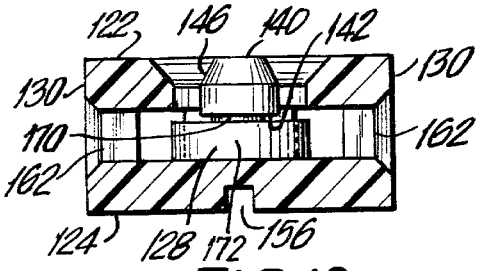
FIG. 10 is a cross-sectional view of the second embodiment of the electrical connector of the subject invention, taken along the line 10—10 of FIG. 7.

Connector 100 has increased utility in that it can be mounted on a circuit board in directions both parallel and perpendicular to its longitudinal axis. In order to enhance the operation of the connector, it is preferable that the actuating means be modified in order to exert the required forces on the contact to effect an elongation in both directions in order to reduce the force of insertion. More specifically, and as illustrated in the figures, the actuator means includes a pair of upstanding, cylindrical actuator rods 170. The cylindrical actuating rods 170 are formed integrally with the upper surface of the bottom cover member 124 and extend upwardly towards the contact receiving aperture 126 of the top cover member 122. A pair of cap retainer members 140 are provided and are integrally formed with the top of each actuator rod 170. The cap retainer member 140, similar to the cap retainer members 40 of the first embodiment, have a chamfered upper surface and a width greater than the diameter of the actuator rods thereby defining an overhanging lip 142, as illustrated in FIG. 10, for maintaining the contact 128 within the housing 120.

Formation of the contact member 144 and its insertion into the housing 120 is accomplished in a manner identical to the first embodiment of the subject invention and need not be further described. In use, the subject connector 100, when provided with dimensions as described herein, can be used to electrically connect pins on a circuit board having either 0.100 or 0.200 inch center spacings. The mechanics of the actual connection are identical with the first embodiment and will be referred to only in brief. As can be appreicated, since the actuating rods 170 are aligned in a direction parallel to the longitudinal axis of the housing, the rods cooperate to define a configuration which is functionally equivalent to the elongated actuator bar 36 of the first embodiment. Thus, if the user wishes to connect the pins on 0.100 inch centers, the connector 100 is oriented in a manner similar to the connector 10 of the first embodiment, with the pin receiving apertures 160 of a side wall 132 being mounted over the pins. As in the first embodiment of the subject invention, if the connecting pins are of sufficient length, a redundant electrical connection will be established between the opposed edges 148 of both distal ends of the contact 128. In the alternative, the connector may be used to establish electrical contact between pins having 0.200 inch centers. The latter connection is achieved by rotating the connector 90° such that the pin receiving apertures 162 are in position to be mounted on the pins. During the mounting procedure, the pin members assist the pushing action such that the actuator rods 170 exert a force on the radially inner leading portion of the contact member 128 thereby effecting an elongation thereof, in a direction parallel to the mounting direction, thereby reducing the pushing force necessary to mount the connector 100. Once the connector is fully mounted, the actuator rods 170 stop exerting any forces enabling the contact to revert towards its initial configuration to produce a secure interference fit between the opposed distal edges 172 of the contact member 128 and the pins.

Figure 12:
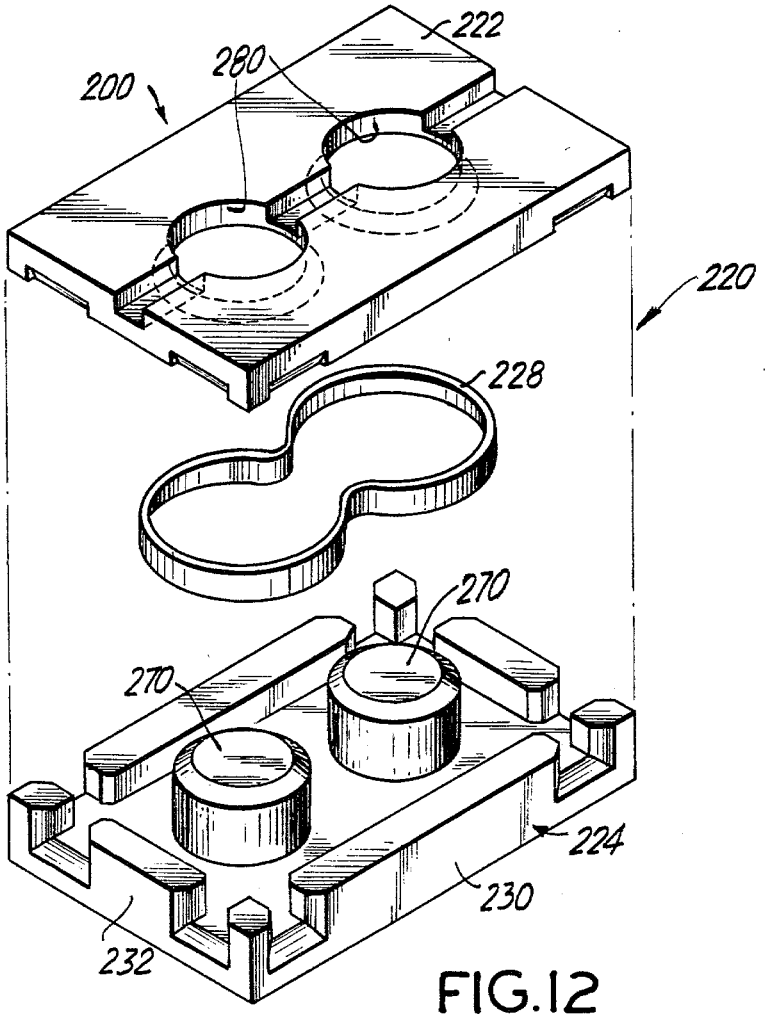
FIG. 12 is an exploded perspective view of a third embodiment of the electrical connector for reduced pin grid applications of the subject invention.
Figure 13:
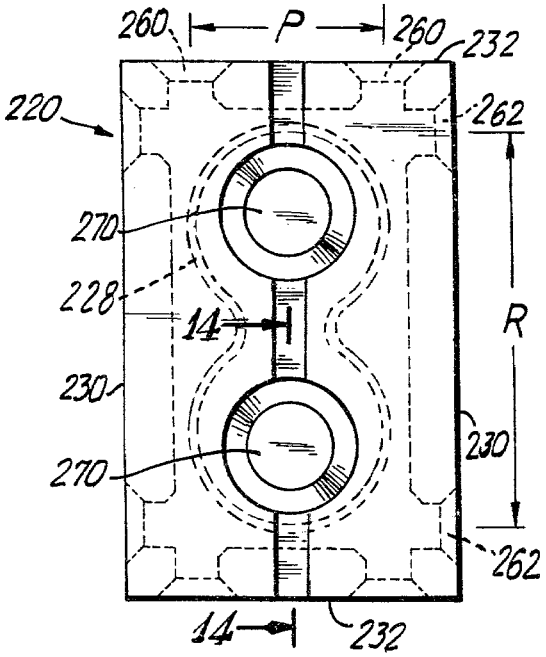
FIG. 13 is a top plan view of the third embodiment of the electrical connector of the subject invention.
Figure 14:
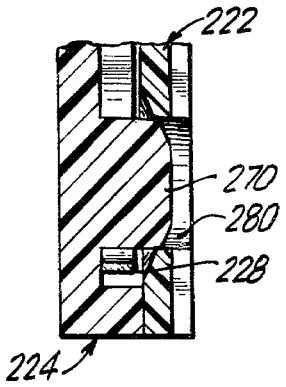
FIG. 14 is a partial cross-sectional view of the third embodiment of the electrical connector of the subject invention, taken along the line 14—14 of FIG. 13.

Referring to FIGS. 12–14, a third embodiment of the electrical connector 200 of the subject invention is illustrated. As will become apparent, connector 200 is essentially functionally equivalent to connector 100 of the second embodiment of the subject invention, as illustrated in FIGS. 6–10.

Electrical connector 200 includes a generally rectangular housing 220 formed of a two-piece construction. More specifically, housing 220 includes opposed top and bottom cover members 222 and 224 respectively. Bottom cover member 224 includes two upstanding cylindrical rods 270 which are aligned in a direction parallel to the longitudinal axis of the housing 220, to define an elongated actuator means. Top cover member 222 is preferably provided with two generally circular apertures 280, which are disposed in alignment with the actuator rods 270. The diameter of each aperture 280 substantially conforms to the diameter of the actuator rods 270, such that during the assembly of the housing 220, the top cover member 222 can be connected to the bottom cover member 224 with the actuator rods 270 being receivable within the apertures 280, in frictional engagement, as illustrated in FIG. 14. By this arrangement, the two part housing can be readily assembled in a "snap fit" manner. Of course, it will be appreciated that various other means for connecting the cover members may be utilized. For example, the cover members could be ultrasonically welded or fused to form the housing 220.

Prior to connecting the cover members, contact member 228 is installed about the upstanding rods 270. Accordingly, the subsequent assembly of the housing 220 functions to securely trap contact member 228 therein. Thus, in this embodiment, the necessity of providing a contact receiving aperture in the top cover member 222 is eliminated.

Once the two part housing has been assembled with the contact member 228 disposed therein, a configuration is acheived which is functionally similar to the connector 100, illustrated in FIGS. 6–10. More specifically, the assembled housing 220 includes two opposed pairs of side walls 230 and 232. Each side wall 232 includes a pair of pin receiving apertures 260 which are chamfered and have a center spacing P, equal to 0.100 inches. As in the second embodiment of the subject invention, pin receiving apertures 260 are adapted to receive pins spaced apart on 0.100 inch centers. The remaining side walls 230 are also provided with pin receiving apertures 262 which are chamfered and have a center spacing R, equal to 0.200 inches to accommodate pin grids that are spaced apart on 0.200 inch centers.

In use, the mechanics of the electrical connection between connector 200 and the pins of a grid is identical to the second embodiment of the subject invention and need not be further described. The two part housing of the third embodiment represents an alternative fabrication technique which yields a structure having all the resultant advantages inherent to the previously described, one piece integral connector embodiment.

In summary, there is provided a new and improved female electrical connector for electrically connecting pairs of spaced apart substantially parallel conductive pin members. The connector is provided with an elongated housing having top and bottom cover members and further including an actuating means formed integrally therewith and extending between the cover members. In accordance with the subject invention, an elongated continuous electrically conductive contact member is provided having a dumbbell-shaped configuration. The contact member is disposed about the actuator means in a loose fit relationship. In one preferred embodiment of the subject invention, a pair of generally rectangular pin receiving apertures are provided adjacent the distal ends of the contact member. In use, the subject connector is mounted over a pair of adjacent pins of a circuit board, with reduced mounting forces, and is capable of establishing a redundant electrical connection between the inner contact member and the pins. In an alternative embodiment of the subject invention, the remaining side walls of the housing are provided with pin receiving apertures which are spaced apart a distance different than the distance between the apertures provided in the side walls adjacent the distal ends of the contact member. By this arrangement, the subject connector is capable of electrically connecting pins having different spacings therebetween.

While there have been described herein what are at present considered preferred embodiments of the subject invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. An electrical connector for electrically connecting a pair of spaced apart, substantially parallel conductive pin members comprising:

an elongated, hollow housing having top and bottom cover members, said housing further including an elongated actuator means formed integrally therewith, said actuator means extending between said cover members with the longitudinal axis thereof being parallel to the longitudinal axis of said housing; and an elongated, continuous electrically conductive contact member, said contact member being resilient and having a dumbbell-shaped configuration, said contact member being disposed about said actuator means in a loose fit relationship, and with the distal ends of said contact member each defining a pair of opposed edges disposed parallel to the mounting direction of the connector, said opposed edges being spaced apart a distance greater than the distance between said spaced apart pin members such that when said connector is initially pushed over said pin members, the pin members resist said pushing action such that the actuator means of said connector housing exerts a force on the radially inner lead portion of said contact member to effect an elongation of said contact member thus reducing the pushing force required to overcome the resistance of said pin members whereby said connector is capable of being readily pushed over said pin members until each said pin member is respectively disposed in abutting relationship with one said opposed edge, in each said pair thereof, at both distal ends of said contact member, such that when said pushing action is stopped, said actuator means of the connector housing ceases to exert said force on the contact member and the contact member tends to revert to its original configuration to effect a secure interference fit and redundant electrical connection between the pins and the contact member.

2. An connector as recited in claim 1 wherein said housing is rectangular having four upstanding side wall members connected between said cover members and wherein at least one of said side walls adjacent a distal end of said contact member includes a generally rectangular pin receiving aperture, said aperture having a length greater than the distance between said conductive pin members.

3. A connector as recited in claim 2 wherein said top cover member includes a generally rectangular contact receiving aperture wherein the length of said aperture is greater than the length of said contact member and wherein the width of said aperture is less than the maximum width of said contact member.

4. A connector as recited in claim 3 further including a cap retainer means integrally formed with said actuator means and disposed adjacent said top cover member, said cap retainer means having a width greater than said actuator means and cooperating with said rectangular contact receiving aperture to retain said contact member within said housing.

5. A connector as recited in claim 1 of generally rectangular configuration including two pairs of opposed side wall members extending between said cover members.

6. A connector as recited in claim 5 wherein each side wall member of said opposed pair adjacent said distal ends of said contact member includes a generally rectangular pin receiving aperture having a length greater than the distance between said conductive pin members.

7. A connector as recited in claim 5 wherein each side wall member in said opposed pair adjacent said distal ends of said contact member includes a pair of substantially square openings, said pairs of openings defining first pairs of apertures in said housing for receiving said conductive pin members.

8. A connector as recited in claim 7 wherein each said side wall member of the remaining pair includes a pair of substantially square openings defining second pairs of receiving apertures, with the spacing between said apertures of said second pairs being different than the spacing between said apertures of said first pairs such that said electrical connector is capable of electrically connecting conductive pin members having different spacings therebetween.

9. A connector as recited in claim 8 wherein the spacing between the center of said apertures of said first pairs is equal to 0.100 inches and the spacing between the center of said apertures of said second pairs is equal to 0.200 inches.

10. A connector as recited in claim 8 wherein said actuating means consists of a pair of upstanding cylindrical rods integrally formed with the upper inner surface of said bottom cover member.

11. A connector as recited in claim 10 wherein said top cover member includes two rod receiving apertures, said rod receiving apertures being aligned with said upstanding cylindrical rods of said bottom cover member, such that the upper ends of said rods are received in said apertures, in frictional engagement with said top cover member thereby securing said top cover member to said bottom cover member.

12. A connector member as recited in claim 1 wherein the lower outer surface of said bottom cover member includes a groove extending parallel to the longitudinal axis of said housing.

13. An electrical connector for electrically connecting a pair of spaced apart, substantially parallel conductive pin members comprising:

an elongated, generally rectangular hollow housing having top and bottom cover members and further including two pairs of opposed side wall members extending between said cover members, with each side wall of said pair adjacent the distal ends of said elongated rectangular housing including a generally rectangular pin receiving aperture, said aperture having a length greater than the distance between said conductive pin members, said housing further including an elongated actuator bar formed integrally therewith, said actuator bar extending between said cover members with the longitudinal axis thereof being parallel to the longitudinal axis of said housing; and an elongated, continuous, electrically conductive contact member, said contact member being resilient and having a dumbbell-shaped configuration, said contact member being disposed about said actuator bar in a loose fit relationship, and with the distal ends of said contact member each defining a pair of opposed edges disposed parallel to the mounting direction of the connector, said opposed edges being spaced apart a distance greater than the distance between said spaced apart pin members such that when said connector is initially pushed over said pin members, the pin members resist said pushing action such that the actuator bar of said connector housing exerts a force on the radially inner lead portion of said contact member to effect an elongation of said contact member thus reducing the pushing forces required to overcome the resistance of said pin members, wherein said connector is capable of being readily pushed over said pin members until each said pin member is respectively disposed in an abutting relationship with one said opposed edge, in each said pair thereof, at both distal ends of said contact member, such that when said pushing action is stopped, said actuator bar of the connector housing ceases to exert said force on the contact member and the contact member tends to revert to its original configuration to effect a secure interference fit and redundant electrical connection between the pin members and the contact member.

14. A connector as recited in claim 13 wherein said top cover member includes a generally rectangular contact receiving aperture with the length of said aperture being greater than the length of said contact member and with the width of said aperture being less than the maximum width of said contact member.

15. A connector as recited in claim 14 further including a cap retainer means integrally formed with said actuator bar and disposed adjacent said top cover member, said cap retainer means having a width greater than said actuator bar and cooperating with said rectangular contact receiving aperture to retain said contact member within said housing.

16. An electrical connector for electrically connecting a pair of spaced apart, substantially parallel conductive pin members comprising:

an elongated, generally rectangular hollow housing having top and bottom cover members and further including two pairs of opposed side wall members extending between said cover members, with each said side wall member in said opposed pair adjacent the distal ends of said elongated rectangular housing including a pair of substantially square openings, each pair of openings defining first pairs of pin receiving apertures, with each side wall member of the remaining pairs including a pair of substantially square openings, the latter openings defining second pairs of pin receiving apertures, with the spacing between said apertures of said first pairs being different than the spacing between said apertures of said second pairs, said housing further including an elongated actuator means with the longitudinal axis thereof being parallel to the longitudinal axis of said housing, said actuator means being defined by a pair of upstanding cylindrical rods extending between said cover members; and an elongated, continuous, electrically conductive contact member, said contact member being resilient and having a dumbbell-shaped configuration, said contact member being disposed about said actuator means in a loose fit relationship, with each distal end of said contact member defining a pair of opposed edges disposed parallel to the longitudinal axis of said housing in a first mounting direction of said connector, and with the opposed distal edges of said contact member defining a second pair of edges disposed perpendicular to the longitudinal axis of said connector and parallel to a second mounting direction whereby said connector may be utilized to electrically connect conductive pin members having different spacings therebetween with said actuator means cooperating with said contact member to reduce the mounting force required to mount said connector.

17. A connector as recited in claim 16 wherein said upstanding cylindrical rods of said actuator means are formed integrally with said bottom cover member and wherein said top cover member includes two rod receiving apertures, said rod receiving apertures being aligned with said upstanding cylindrical rods of said bottom cover member, such that the upper ends of said rods are received in said apertures, in frictional engagement with said top cover member thereby securing said top cover member to said bottom cover member.

18. A connector as recited in claim 16 wherein the spacing between the centers of said apertures in said first pairs is equal to 0.100 inches and the spacing between the centers of said apertures of said second pairs is equal to 0.200 inches.

19. An electrical connector for electrically connecting a pair of spaced apart, substantially parallel conductive pin members comprising:

an elongated, generally rectangular hollow housing having top and bottom cover members and further including two pairs of opposed side wall members extending between said cover members, with each said side wall member in the opposed pair disposed parallel to the longitudinal axis of said elongated housing including a pair of substantially square openings, each said pair of openings defining a pair of pin receiving apertures, said housing further including an elongated actuator means with the longitudinal axis thereof being parallel to the longitudinal axis of said housing, said actuator means being defined by a pair of upstanding cylindrical rods extending between said cover members; and an elongated, continuous, electrically conductive contact member, said contact member being resilient and having a dumbbell-shaped configuration, said contact member being disposed about said actuator means in a loose fit relationship, with the opposed distal edges of said contact member defining a pair of contact edges disposed perpendicular to the longitudinal axis of said connector and parallel to the mounting direction thereof, whereby said connector may be utilized to electrically connect a pair of conductive pin members with said actuator means cooperating with said contact member to reduce the mounting force required to mount said connector.

20. A connector as recited in claim 19 wherein said upstanding cylindrical rods of said actuator means are formed integrally with said bottom cover member and wherein said top cover member includes two rod receiving apertures, said rod receiving apertures being aligned with said upstanding cylindrical rods of said bottom cover member, such that the upper end of said rods are received in said apertures, in frictional engagement with said top cover member thereby securing said top cover member to said bottom cover member.

* * * * *